United States Patent [19]

Lewis, Jr.

[11] 4,037,841

[45] July 26, 1977

[54] LACROSSE STICK HAVING TUBULAR METALLIC HANDLE

[75] Inventor: Fielding H. Lewis, Jr., Towson, Md.

[73] Assignee: W. T. Burnett & Co., Baltimore, Md.

[21] Appl. No.: 522,578

[22] Filed: Nov. 11, 1974

[51] Int. Cl.[2] ..... A63B 59/02

[52] U.S. Cl. ..... 273/96 D

[58] Field of Search ..... 273/72 A, 80 R, 80 B, 273/96 D

[56] References Cited

U.S. PATENT DOCUMENTS

| | | | |
|---|---|---|---|
| 1,540,559 | 6/1925 | Murphy | 273/80 B |
| 1,573,707 | 2/1926 | Hoerle | 273/80 B |
| 1,787,415 | 12/1930 | Washington | 273/80 B |
| 2,472,930 | 6/1949 | Wilkes | 273/80 B |
| 3,473,806 | 10/1969 | Patterson | 273/96 D |
| 3,479,030 | 11/1969 | Merola | 273/72 A |
| 3,507,495 | 4/1970 | Tucker | 273/96 D |
| 3,530,048 | 9/1970 | Darrow | 273/80 R |
| 3,685,135 | 8/1972 | Letters | 273/80 B |
| 3,702,702 | 11/1972 | Hoult | 273/96 D |
| 3,854,316 | 12/1974 | Wilson | 273/72 A X |

FOREIGN PATENT DOCUMENTS

| | | | |
|---|---|---|---|
| 518,699 | 3/1940 | United Kingdom | 273/80 B |

OTHER PUBLICATIONS

Chemical Engineers' Handbook, 1941, p. 2138.

*Primary Examiner*—Richard J. Apley
*Attorney, Agent, or Firm*—Diller, Brown, Ramik & Wight

[57] ABSTRACT

A lacrosse stick has a tubular metallic handle, disclosed as of aluminum alloy and being elliptical in cross section with the major axis of the elliptical shape being normal to the general plane of the lacrosse stick head. Dimensions and physical properties of the handle material are interrelated to provide desired balance of the lacrosse stick as a whole considered from the standpoint of handling by players, durability, freedom from failure by fracturing, and standardization in production.

12 Claims, 5 Drawing Figures

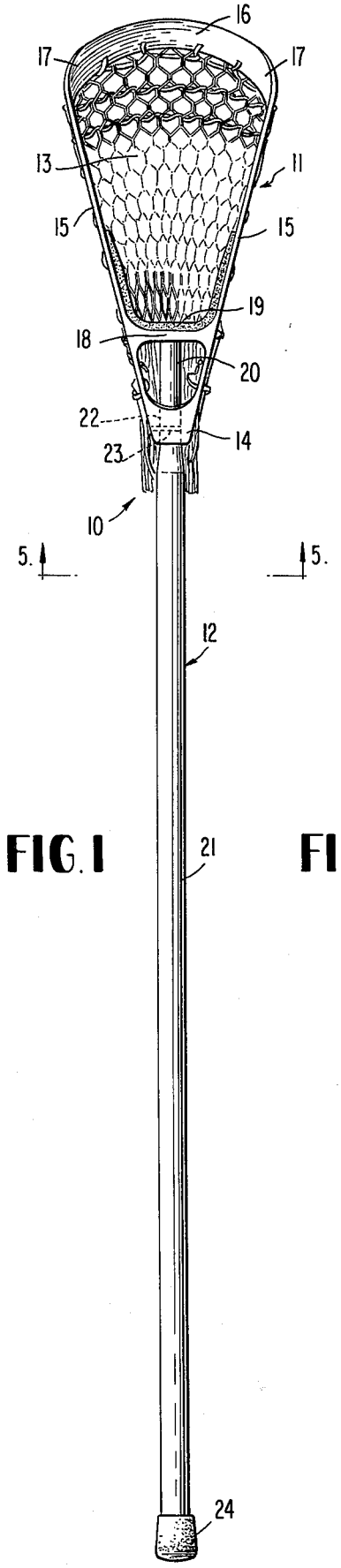
FIG. 1
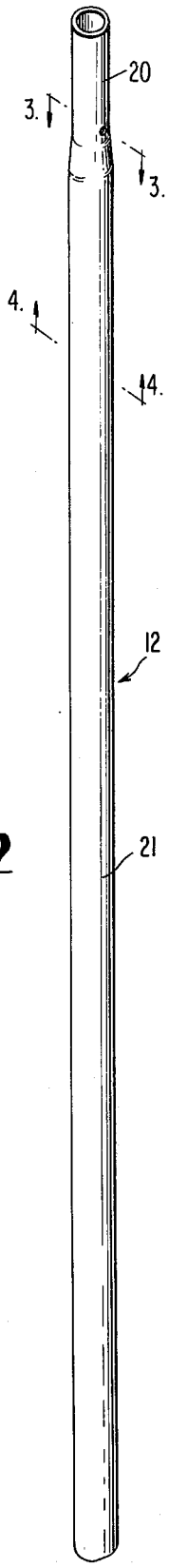
FIG. 2
FIG. 3
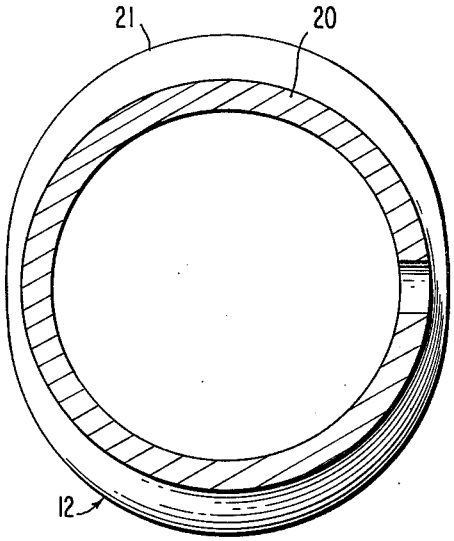
FIG. 4
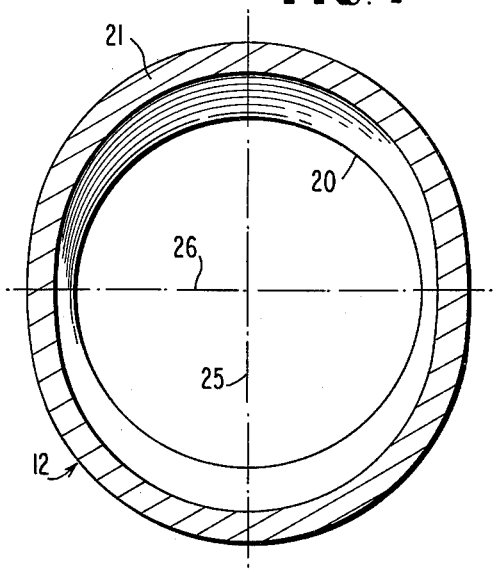
FIG. 5
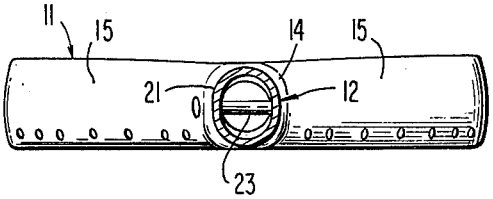

LACROSSE STICK HAVING TUBULAR METALLIC HANDLE

This invention relates to lacrosse sticks, and especially to a lacrosse stick including a handle formed of metallic tubing which has such physical properties and is so formed as to provide advantages as to strength, safety, weight distribution, and comfortable feel in the hands of a player.

BACKGROUND OF THE INVENTION

Lacrosse is an ancient game. In the prior art, lacrosse stick handles have customarily been made of wood, usually hickory, shaped by American and Canadian Indians with whom the game originated. Such handles, being rather roughly handcrafted, lack uniformity as to quality, strength, weight, and feel in the hands of a player. Probably more importantly the prior art handles are susceptible to failure by fracturing, leaving jagged ends with a resultant extreme danger of severe injury to players of a game so roughly played. U.S. Pat. No. 3,702,702 to Hoult dated Nov. 14, 1972 proposes the use of a lacrosse stick handle comprising a composite of an outer plastic tube (illustrated as non-metallic) of octagonal cross section and an inner core of wood or aluminum.

SUMMARY OF THE INVENTION

The present invention provides a lacrosse stick having a tubular metallic handle overcoming disadvantages of prior art handles, especially with respect to standardization, desirable weight distribution with the stick head, and very importantly strength and avoidance of fracturing. Overcoming such disadvantages of prior art handles is a general object of the invention.

A more particularly stated object of the invention is to balance, that is, correlate the cross sectional shape, the weight distribution and the physical properties of the handle material so as to provide a lacrosse stick having a desired feel in the hands of players, and a high degree of safety.

Other objects of the invention will become apparent from a reading of the appended claims and the accompanying drawings.

BRIEF DESCRIPTION OF THE DRAWINGS

FIG. 1 is an elevational view of a lacrosse stick embodying the invention;

FIG. 2 is an enlarged scale perspective view of the lacrosse stick handle;

FIG. 3 is a cross section on the line 3—3 of FIG. 2 on a scale enlarged with respect to FIG. 2;

FIG. 4 is a section on the line 4—4 of FIG. 2 on the same scale as in FIG. 3; and FIG. 5 is a section on the line 5—5 of FIG. 1 on an enlarged scale, showing the lacrosse stick head in bottom plan.

The illustrative embodiment of the invention is a lacrosse stick generally designated 10 which includes a head generally designated 11 and a handle generally designated 12. The head is provided with webbing or netting generally indicated at 13.

The head 11 is constructed similarly to a head disclosed in the Tucker et al. U.S. Pat. No. 3,507,495 of Apr. 21, 1970 and shown also in a later Tucker et al. U.S. Pat. No. 3,822,062 of July 2, 1974. The head 11 is, in general, a closed frame-like construction of somewhat V-shape, preferably substantially symmetrical. The lower end of the head is formed as a throat 14 from which two side walls 15, 15 are inclined and diverge upwardly and outwardly. The upper ends of the side walls 15, 15 are connected by a transverse top or end wall 16 which merges with the side walls through intervening smoothly curved portions 17, 17.

A transverse stop 18 extends between the side walls 15, 15 and cooperates with the throat 14 and adjacent portions of the side walls to facilitate the connection of the head 11 and the handle 12. Positioned inside the stop 18 is a layer 19 of relatively soft resilient material which provides for improved ball handling properties.

The Tucker et al. U.S. Pat. No. 3,882,062 more particularly discloses an arrangement which may be embodied in the webbing 13 shown in FIG. 1 by way of example. Since details of construction of the webbing per se are not part of the present invention, reference to U.S. Pat. No. 3,822,062 is believed to be sufficient as to disclosure of one suitable kind of webbing.

The head 11, aside from the webbing 13, is preferably formed as a unitary molding of an elastomer characterized by toughness, impact resistance and limited flexibility as well as other desirable properties explained in the aforesaid U.S. Pat. No. 3,507,495. A preferred material is:

| | Parts by weight |
|---|---|
| Adiprene L-315[1] | 100 |
| 4,4'-methylene-bis-(2 chloroaniline) | 26 |

[1]Adiprene L-315 is DuPont's trade name for a prepolymer based on poly(1,4-oxybutylene) glycol and tolylene diisocyanate. The prepolymer has the following specifications:
Available isocyanate content, percent - 9.45 plus or minus 0.20.
specific gravity at 75° F. - 1.11.
Brookfield viscosity at 86° F. - 15,000 plus or minus 2,500.

The additional information as to such an elastomer, and its molding set forth in U.S. Pat. No. 3,507,495 is incorporated by reference thereto in the present disclosure. The material is referred to as an example of material suitable for constructing the head found to cooperate admirably with a handle having characteristics explained hereinafter.

The invention is more particularly related to the handle 12, although the correlation between the head and the handle is a further aspect of the invention. Primarily, the handle is formed of metal tubing, which, in the illustrative embodiment, is cold drawn seamless aluminum alloy tubing. As shown in FIGS. 2-5, the handle has a relatively longitudinally short top end part 20 of circular cross section and a relatively longer part 21 which is of elliptical cross section extending throughout the major part of the handle. The head throat 14 and stop 18 have aligned openings (one, 22, being indicated in the throat 14 in FIG. 1) which receive the circular cross section end part 20 of the handle 12 for detachably connecting the handle to the head. Any suitable fastening device such as a screw indicated at 23 in FIG. 1 may be used for releasably securing the head to the handle.

A cap 24 of relatively soft material such as rubber or plastic is fitted over the lower end of the handle.

Contributing importantly to the invention are the elliptical cross-sectional formation of the major part of the handle and the physical characteristics of the handle which, as stated, may be formed from cold drawn aluminum alloy tubing. The handle stock before formation may be of circular cross section, one inch outside diameter. The upper end part 20 is swaged to a reduced diameter to fit in the openings 22 in the head. The handle part below the reduced diameter part 20 is then bumped, pressed or otherwise worked by a known procedure to form it to the elliptical cross section shown in FIG. 4. When the handle has been formed thusly, its end 20 is inserted into the head openings 22 with the major axis 25 of the elliptical part of the handle normal to the general plane of the head 11 and the minor axis 26 generally parallel to the head plane. The cross section of the handle part 21 need not be exactly elliptical in the mathematical definition sense of the term. The cross section is, however, so closely in the form of an ellipse as properly to be termed elliptical for the purpose of this disclosure.

Dimensional relationships may vary somewhat according, for example, to whether the handle is to be part of a lacrosse stick used by attack and midfield players or is to be used by defense players. Generally considered, lacrosse sticks used by defense players may suffer more frequent and sometimes more severe shocks, as by impact, than the attack and midfield sticks.

Factors of lightness, limited flexibility and strength contribute to the suitability for use by attack and midfield players. In a preferred handle for an attack and midfield stick, using an aluminum alloy as disclosed hereinafter, a preferred wall thickness is 0.065 inch, although a wall thickness in the range 0.060 inch to 0.090 inch may be used in accordance with the invention. An important consideration is the ratio of the length of the minor axis of the elliptical cross section to the length of the major axis. Balancing the considerations of comfortable feel in the hands of the player, resilience, strength and resistance to deformation, an optimum ratio of 0.88 of the length of the minor axis to the length of the major axis is preferred. This ratio is based on a minor axis length of from 0.925 inch to 0.955 inch and a major axis length of from 1.050 inch to 1.080 inch for handles incorporated in attack and midfield sticks. The ratio may, however, range from 0.80 to 0.93, although a ratio within the range 0.83 to 0.90 is preferred.

Different balancing of a lacrosse stick may be preferred by different players. However, as a general guideline, reference is made to a typical stick in which the head weighs substantially 11 ounces and the attack and midfield handle weighs approximately 0.224 pounds per lineal foot. Weights may vary, for example as to whether a lacrosse stick is to be used by junior players or varsity or professional players. Nevertheless, the relative weights of the handle and head preferably come within reasonable ranges. For example, for a head within the range of 9 ounces to 13 ounces, the weight of the handle should preferably be within the range 0.220 to 0.285 pounds per lineal foot. The total weight of the handle may vary according to its length. For an attack or midfield stick, the handle may be furnished about 40 inches long and the players using the stick may cut it down to any length of from 26 to 40 inches to suit the player's individual feel and preference.

Since lacrosse sticks are subjected to rough contact, especially whacks or blows, physical properties of the handle material are important. Of outstanding importance is the modulus of elasticity, although ultimate strength, yield strength and elongation have to be considered. The modulus of elasticity is defined as the ratio of stress to corresponding strain throughout the range where they are proportional. In this disclosure, the modulus of elasticity is considered as an average of the modulus in compression and the modulus in tension, the compression modulus being roughly 2% greater than the tension modulus.

For use in a handle for an attack - midfield stick the preferred modulus of elasticity as defined above is 10.0 $\times$ $10^3$, ksi being thousand pounds per square inch. While this is the preferred value, the modulus of elasticity may be within the range 10.0 $\times$ $10^3$ to 10.4 ksi $\times$ $10^3$, depending upon the stiffness desired, and even some reasonable departure from that range may be tolerated.

An aluminum alloy having such a modulus of elasticity preferably has an ultimate strength (tension) of 40 ksi, a yield strength (tension) 35 ksi and an elongation of 8% in 2 inches, although good results are obtainable with a range of ultimate strength (tension) 40–45 ksi, yield strength (tension) 35–40 ksi and elongation 5–12% in 2 inches. Some variation reasonably beyond such ranges, according to availability of alloys, may be acceptable while still obtaining advantages of the invention.

A lacrosse stick handle of an alloy having physical properties such as are set forth above will not fracture when subjected to heavy load, as by impact, as would a wood or fiberglass handle. Any stress induced failure of a handle according to this invention would be by way of plastic deformation, minimizing the danger of injury to a player.

Preferred aluminum alloys are those designated 6060-T6, T651 and 6063-T832 in "aluminum standards and data 1972–73" published by THE ALUMINUM ASSOCIATION, 750 THIRD AVENUE, NEW YORK, N.Y. 10017 hereinafter referred to as ASD. This publication gives physical properties on which the foregoing disclosure is based, as well as chemical analyses limit ranges of the alloys. The following is given for the 6061 group alloys:

| | |
|---|---|
| Silicon | 0.40 - 0.8 |
| Iron | 0.7 |
| Copper | 0.15 - 0.40 |
| Manganese | 0.15 |
| Magnesium | 0.8 - 1.2 |
| Chromium | 0.04 - 0.35 |
| Zinc | 0.25 |
| Titanium | 0.15 |
| Others, each | 0.05 |
| Others, total | 0.15 |
| Aluminum | Remainder |

The following analysis given by limits by the publication ASD for the 6063 alloys group:

| | |
|---|---|
| Silicon | 0.20 - 0.6 |
| Iron | 0.35 |
| Copper | 0.10 |
| Manganese | 0.10 |
| Magnesium | 0.45 - 0.9 |
| Chromium | 0.10 |
| Zinc | 0.10 |
| Titanium | 0.10 |
| Others, each | 0.05 |
| Others, total | 0.15 |
| Aluminum | Remainder |

Alloys referred to above are suitable for use in the handles of attack - midfield sticks. Other alloys having the required and similar physical properties may be used.

Handles for defense sticks are of elliptical cross section and should be of material having physical properties as set forth above. As in the case of handles for attack and midfield sticks, aluminum alloys 6061-T6, T651 and 6063-T832 may be used. However, because of the rougher use to which defense sticks may be subjected, there are some differences in the dimensions of the defense stick handle as compared to those of the attack and midfield handle. Balancing such factors as lightness and strength, the optimum wall thickness of a defense stick handle is 0.083 inch, somewhat above the 0.065 inch thickness of the attack and midfield handle wall thickness. The defense handle wall thickness may vary in a range up to 0.090 inch. A defense stick handle having the optimum wall thickness 0.083 inch weighs 0.281 pounds per lineal foot. A defense stick head is only slightly heavier than an attack and midfield stick head, that is approximately 11 ounces in a typical case, but the weight of the defense stick head may range up to 13 ounces. Normally a defense stick is furnished with a handle 58 inches long, and the particular player may cut it down to suit his individual feel and preference to 44 inches long or even less.

As in the case of an attack and midfield stick handle, the defense stick handle has an elliptical cross section, the ratio of the length of the minor axis to the length of the major axis preferably being 0.88. This is based on a minor axis length of from 0.925 to 0.955 inch and a major axis length of from 1.050 inch to 1.080 inch. The ratio may range from 0.80 to 0.93, although a ratio within the range 0.83 to 0.90 is preferred.

Lacrosse sticks according to this invention have the advantage of being producible with standardization in weight distribution and physical properties and hence durability. The elliptical cross section provides for comfortable grasp and feel desired by players and also distributes the material of the handle so as most efficiently to withstand stress for a given weight of handle. In case of extremely hard contact, any deformation of the handle is a plastic deformation as distinguished from breaking or fracturing to which prior art wooden and fiberglass handles are susceptible. Eliminating fracturing of handles is an important safety consideration. Furthermore, handles in accordance with the invention will not warp. The advantages set forth above by way of illustration are obtained by the balancing of weight and distribution of the material in the handle of elliptical cross section taken in connection with the physical properties of the handle material.

The lacrosse stick illustrated and described embodies the invention in a preferred form, but the disclosure is intended to be illustrative rather than definitive.

I claim:

1. A lacrosse stick comprising a head; and a tubular metallic handle of elliptical cross-section, the major axis of said cross-section being normal to the general plane of said head, and the ratio of the length of the minor axis to the length of the major axis of said elliptical cross-section is within the range 0.8 to 0.93.

2. A lacrosse stick according to claim 1 in which the ratio of the length of said minor axis to the length of said major axis is approximately 0.88.

3. A lacrosse stick according to claim 2 in which said handle is of aluminum alloy having an average of tension and compression modulus of elasticity $10.0 \times 10^3$, ksi being thousand pounds per square inch.

4. A lacrosse stick according to claim 1 in which the wall thickness of said handle is within the range 0.060 to 0.090 inch, said head having a weight in the range of 9 to 13 ounces, said handle being from 26 to 60 inches long and weighing in the range 0.200 to 0.285 pounds per lineal foot.

5. A lacrosse stick according to claim 4 in which said handle is of aluminum alloy having an average of tension and compression modulus of elasticity from $10 \times 10^3$ to $10.4 \times 10^3$, ksi being thousand pounds per square inch.

6. A lacrosse stick according to claim 1 in which said handle is of aluminum alloy having an average tension and compression modulus of elasticity from $10.0 \times 10^3$ to 10.4 ksi $\times 10^3$, ksi being thousand pounds per square inch.

7. A lacrosse stick according to claim 1 in which said handle is of aluminum alloy having an average tension and compression modulus of elasticity $10.0 \times 10^3$, ksi being thousand pounds per square inch.

8. A lacrosse stick according to claim 8 in which said handle is of aluminum alloy having physical properties:

Ultimate Strength (Tension) 40–45 ksi
Yield Strength (Tension) 35–40 ksi
Elongation, percent in 2 inches 5–12%
An average of tension and compression, modulus of elasticity $10.0 \times 10^3$ to $10.4 \times 10^3$, ksi being thousand pounds per square inch.

9. A lacrosse stick according to claim 1 in which said handle is of aluminum alloy having physical properties:

Ultimate Strength (Tension) 40 ksi
Yield Strength (Tension) 35 ksi
Elongation, percent in 2 inches 8%
An average of tension and compression, modulus of elasticity 10 ksi $\times 10^3$, ksi being thousand pounds per square inch.

10. A lacrosse stick comprising a head; and a tubular metallic handle of elliptical cross-section, the major axis of said cross-section being normal to the general plane of said head, said head has a weight in the range of 9 to 13 ounces and said handle is of a length within the range 26 to 60 inches and a weight in the range of 0.220 to 0.285 pounds per lineal foot.

11. A lacrosse stick according to claim 10 in which said head weighs approximately 11 ounces and said handle weighs approximately 0.281 pounds per lineal foot.

12. A lacrosse stick according to claim 10 in which said head weighs approximately 11 ounces and handle weighs approximately 0.224 pounds per lineal foot.

* * * * *